United States Patent [19]

Sawato et al.

[11] Patent Number: 4,742,430

[45] Date of Patent: May 3, 1988

[54] SEWING MACHINE DRIVING CONTROL BOX

[75] Inventors: Tatsuya Sawato; Yutaka Yamaura, both of Aichi, Japan

[73] Assignee: Mitsubishi Denki Kabushiki Kaisha, Tokyo, Japan

[21] Appl. No.: 882,003

[22] Filed: Jul. 3, 1986

[30] Foreign Application Priority Data

Jul. 4, 1985 [JP] Japan ..... 60-102104[U]

[51] Int. Cl.[4] ..... H05K 1/14

[52] U.S. Cl. ..... 361/395; 112/1; 361/397; 361/399; 310/68 D

[58] Field of Search ..... 361/395, 399, 397; 310/68 D, 76

[56] References Cited

U.S. PATENT DOCUMENTS

| | | | |
|---|---|---|---|
| 3,934,177 | 1/1976 | Horbach | 361/427 |
| 4,542,437 | 9/1985 | Ellis et al. | 361/395 |

FOREIGN PATENT DOCUMENTS

| | | |
|---|---|---|
| 0103412A1 | 8/1983 | European Pat. Off. . |
| 1591347 | 12/1970 | Fed. Rep. of Germany . |
| 2105382 | 12/1972 | Fed. Rep. of Germany . |
| 2408961 | 1/1975 | Fed. Rep. of Germany . |
| 2930228 | 2/1981 | Fed. Rep. of Germany . |
| DE3151392.1 | 7/1983 | Fed. Rep. of Germany . |
| 1021230 | 3/1966 | United Kingdom . |
| 1598032 | 9/1981 | United Kingdom . |

OTHER PUBLICATIONS

DE-Z "Variostop", pp. 466–470.

Nahmaschinenmotoren, Verfahren, Maschinen, Hilfsmittel, Seite 203 to Seite 206.

*Primary Examiner*—Robert S. Macon

*Attorney, Agent, or Firm*—Sughrue, Mion, Zinn, Macpeak, and Seas

[57] ABSTRACT

A sewing machine control box mounted on a non-operative end of a sewing machine frame, and including a partition board which divides the control box into first and second chambers. A transformer which gives off heat in operation is provided in a first chamber, and a printed circuit board which otherwise might be damaged by the heat generated by the transformer is provided in a second chamber. The dividing of the control box into these first and second chambers prevents excessive heat transfer from the transformer to the printed circuit board during operation of the sewing machine.

11 Claims, 3 Drawing Sheets

SEWING MACHINE DRIVING CONTROL BOX

BACKGROUND OF THE INVENTION

The present invention relates to a sewing machine control box.

The structure of a conventional sewing machine control box of the same general type to which the invention pertains is shown in FIGS. 4A and 4B. In FIGS. 4A and 4B, reference numeral 1 designates an adjustable speed clutch motor having an output shaft 1*a*, which is a driving source for the sewing machine; 2, a control box including a printed circuit board 3, a lever section 4 and a transformer 5; 6, a sewing machine driving motor frame; 7, a mounting plate secured to the frame 6 on which the control box 2 is mounted; 8, a cover, secured to the sewing machine driving motor frame 6 with screws, for protection of a motor power source connecting section; 9, a connecting cord for supplying voltage to the primary lead wire of the transformer 5; and 10, connectors for a detector, a sewing machine solenoid, etc.

In the above-described sewing machine driving control box, the number of elements on the printed circuit board 3 is decreased as it employs a hybrid, gate array or microcomputer technique. Therefore, the printed circuit board 3 can be miniaturized.

However, since the conventional control box includes not only the printed circuit board 3 but also the transformer 5, the electronic components on the printed circuit board 3 can be damaged by heat generated by the transformer 5, and hence it is impossible to position the printed circuit board 3 and the transformer 5 adjacent to each other. Consequently, the space within the control box must be quite substantial, and the control box is necessarily large both in volume and in weight.

In U.S. Pat. No. 3,885,175, there is disclosed the structure of a motor in which a housing is provided on an end face of the frame 6 and a transformer is incorporated in the housing. However, the structure is not of the type where the printed circuit board is incorporated in the housing. Accordingly, the above-described disadvantages of the conventional control box are not overcome by the structure disclosed in this patent.

SUMMARY OF THE INVENTION

In a sewing machine driving control box according to the invention, an end of a sewing machine driving motor frame opposite the operative end of the sewing machine is connected to a housing which is divided into first and second chambers by a partition board in such a manner that the first chamber is close to the frame. The first chamber has a ventilating opening and incorporates a transformer, while the second chamber is sealed and incorporates a printed circuit board.

In this sewing machine driving control box according to the invention, the first chamber close to the driving motor frame has the ventilating opening and the transformer, while the second chamber incorporates the printed circuit board. Therefore, the printed circuit board and the transformer can be positioned adjacent to each other through the partition board, and the amount of space required in the housing can be reduced correspondingly.

DESCRIPTION OF THE PREFERRED EMBODIMENT

Figure 1:
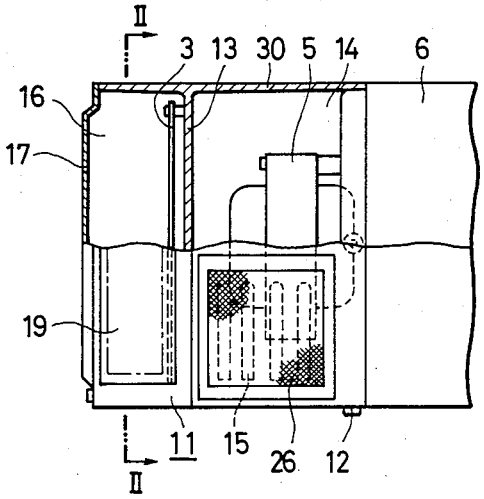
FIG. 1 is a sectional view of a sewing machine driving control box according to the present invention.
Figure 2:
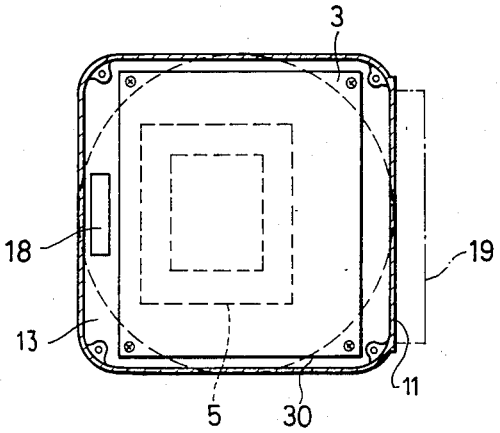
FIG. 2 is a sectional view taken along line II—II in FIG. 1.
Figure 3A:
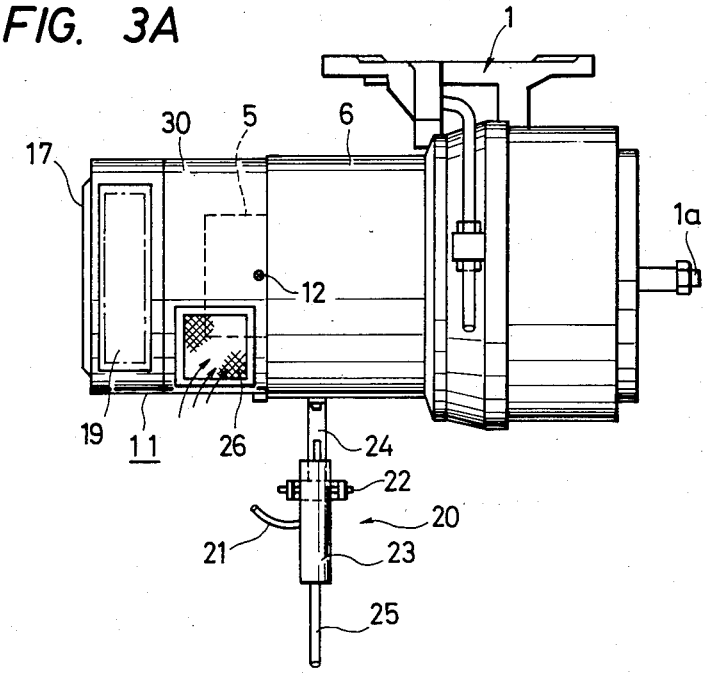
FIGS. 3A and 3B are a front view and a side view, respectively, of the control box mounted on the sewing machine.
Figure 3B:
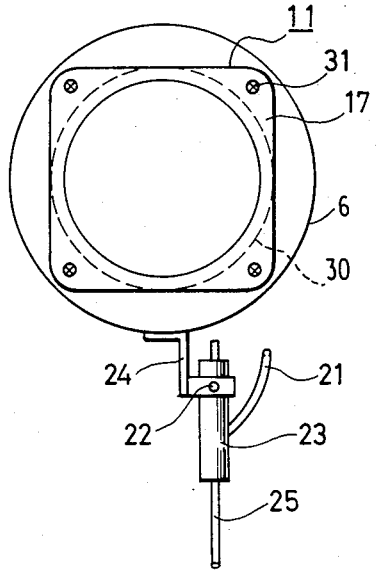
Figure 4A:
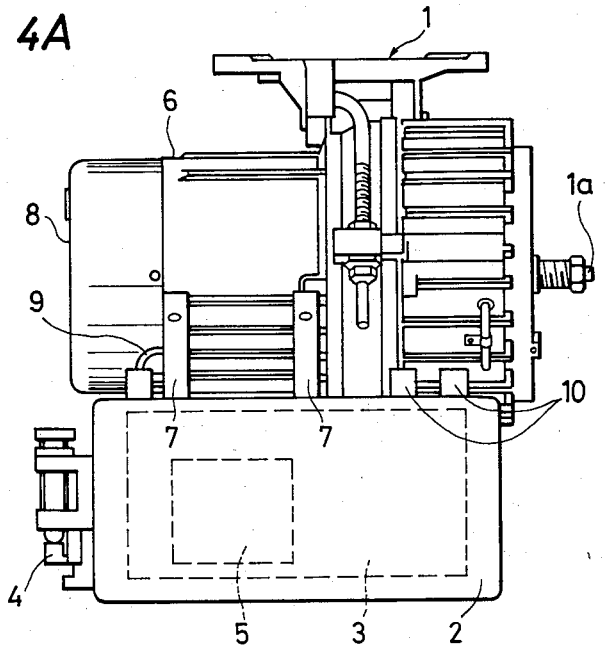
FIGS. 4A and 4B are a front view and a side view, respectively, showing a conventional sewing machine driving control box.
Figure 4B:
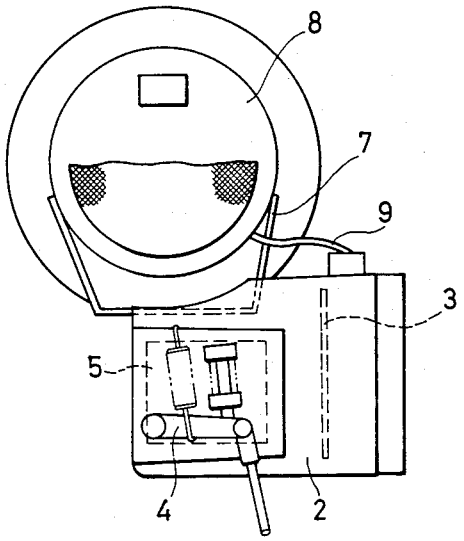

FIG. 1 is a sectional view showing a sewing machine driving control box according to the present invention. FIG. 2 is a sectional view taken along line II—II in FIG. 1. FIGS. 3A and 3B respectively show a front view and a side view of the control box as mounted on a sewing machine. In these Figures, those components which have been already described with reference in FIGS. 4A and 4B are designated by the same reference numerals.

In FIGS. 1 through 3, reference numeral 11 designates a housing composed partially of a cylinder 30; said housing having open ends and being secured with screws 12 to an end of the above-described sewing machine driving motor frame 6 opposite the operative end of a sewing machine (not shown). A cover 17 is attached to a square cross section portion of housing 11 extending the cylinder 30 to close the opening at one end of the housing 11. The inside of the housing 11 is divided into first and second chambers 14 and 16 by a partition board 13, the first chamber being closer to the frame 6 than the second chamber. The first chamber 14, communicated through a ventilating opening 15 with the outside, incorporates the aforementioned transformer 5. The printed circuit board 3 is provided in the second chamber 16. The cover 17 is provided at the second chamber 16 with screws 31 to close the opening of the housing 11, thus closing the first and second chambers. The first chamber 14 is communicated through a window provided on the side wall of the frame 6 with the inside of the frame 6.

Further in FIGS. 1 through 3, reference numeral 18 designates a through-hole formed in the partition board 13 through which the lead wires are extended; 19, connectors secured to the housing 11 to connect the detector, the sewing machine solenoid, etc; and 20, a lever unit connected through a cord 21 to the connectors 19. The lever unit 20 has a lever 23 and a shaft 22, and is connected through a mounting board 24 to the sewing machine driving motor frame 6. In the lever 23, electric contacts are incorporated to provide a speed instruction signal, a pressure bar lifting signal, or a thread cutting signal by operating a pedal (not shown) coupled to a lower end of the shaft 25 of the lever unit 20 to thereby move the shaft 25 up and down.

Also in FIGS. 1 through 3, reference numeral 26 designates a dust filter which is detachably mounted on the ventilating opening 15 of the housing 11. The primary and secondary lead wires of the transformer 5 are connected to the winding of the adjustable speed clutch motor 1 and the printed circuit board 3, respectively.

In the inventive sewing machine driving control box, the housing 11 is divided into first and second chambers 14 and 16 by the partition board 13, and the first chamber 14 is provided with the ventilating opening 15 and incorporates the transformer 5 while the second chamber 16 incorporates the printed circuit board 3. Therefore, the printed circuit board 3 can be positioned adjacent to the transformer through the partition board 13, and the space in the housing 11 can be reduced correspondingly.

In the sewing machine driving control box constructed according to the invention, the entrance of dust into the second chamber 16 incorporating the printed circuit board 3 can be prevented, and cooling air can be introduced through the ventilating opening 15 into the first chamber 14 incorporating the transformer 5. The cooling air is forcibly sent through the first chamber 14 to the inside of the frame 6 as cooling air for the motor 1.

For the sewing machine driving control box of the invention, for balance with the clutch motor mounted on the table (not shown), it is desirable that the outside diameter of the cylinder 30 of housing 11 and the width and height of cover 17 be made equal to that of the sewing machine driving motor frame 6.

As was described above, the housing divided into first and second chambers by the partition board is connected to the non-load side and face of the sewing machine driving motor frame, the first chamber close to the frame has a ventilating opening and incorporates the transformer, while the second chamber incorporates the printed circuit board. Therefore, the printed circuit board and the transformer can be positioned adjacent to each other through the partition board, and the space in the housing can be reduced correspondingly. Accordingly, the control box can be made smaller in size and lighter in weight, and can be mounted on the sewing machine table with higher efficiency.

What is claimed is:

1. A sewing machine driving control box including:

a housing which is provided outside of a side surface of a frame of a sewing machine driving motor, an interior of said housing being divided into first and second chambers, said first chamber being closer to said frame than said second chamber, a ventilating opening being provided in said first chamber;

a transformer incorporates in said first chamber of said housing; and a printed circuit board incorporated in said second chamber of said housing.

2. A sewing machine driving control box as claimed in claim 1, wherein said housing is provided on a wall surface opposite to an output shaft of said sewing machine driving motor.

3. A sewing machine driving control box as claimed in claim 1, wherein said housing comprises a cylinder secured at one end to said frame and a cover attached to said cylinder to close an opening in the other end of said cylinder.

4. A sewing machine driving control box as claimed in claim 1, wherein an outside diameter of said frame is equal to that of said housing.

5. In a sewing machine motor control frame having two ends, a first end facing in the direction of an operative portion of the sewing machine and a second end positioned opposite said first end, a sewing machine driving control box secured to said second end of said frame, said control box comprising:

(a) a housing having open first and second ends, said first end of said housing being secured to said second end of said frame, said housing including ventilating openings positioned in a vicinity of said first end of said housing;

(b) a partition board positioned within said housing and dividing an interior of said housing into first and second chambers, said first chamber being nearer said first end of said housing;

(c) a transformer positioned within said first chamber, said ventilating openings permitting transfer of heat from said transformer to an exterior of said housing;

(d) a printed circuit board positioned within said second chamber, said partition board thereby separating said printed circuit board from said transformer and thereby limiting heat transfer from said transformer to said printed circuit board; and (e) a cover for sealing said second end of said housing, thereby preventing exposure of said printed circuit board to air.

6. A sewing machine driving control box as claimed in claim 5, wherein said partition portion has a throughhole formed therein, said control box further comprising a plurality of lead wires for connecting said transformer to said printed circuit board.

7. A sewing machine driving control box as claimed in claim 5, wherein said housing is secured to said opposite end of said frame with screws, and wherein said cover is secured to said second end of said housing with screws.

8. A sewing machine driving control box as claimed in claim 5, further comprising a plurality of connectors secured to said housing for connecting operative elements of said sewing machine to said printed circuit board.

9. A sewing machine driving control box as claimed in claim 8, wherein said operative elements include a position detector and a sewing machine solenoid.

10. A sewing machine driving control box as claimed in claim 9, further comprising a mounting board mounted on said frame, said operative elements further including a wire connecting said lever unit to said printed circuit board, said lever unit including means for selectively providing a speed instruction signal, a pressure bar lifting signal, or a threaded cutting signal in accordance with operation of a shaft.

11. A sewing machine driving control box as claimed in claim 5, wherein said housing, and said frame have circular cross-sections of substantially equal diameter.

* * * * *